US005417552A

United States Patent [19]

Kayukawa et al.

[11] Patent Number: 5,417,552

[45] Date of Patent: May 23, 1995

[54] SWASH PLATE TYPE VARIABLE DISPLACEMENT COMPRESSOR

[75] Inventors: Hiroaki Kayukawa; Kazuya Kimura; Kenji Takenaka; Hideki Mizutani, all of Kariya, Japan

[73] Assignee: Kabushiki Kaisha Toyoda Jidoshokki Seisakusho, Kariya, Japan

[21] Appl. No.: 213,031

[22] Filed: Mar. 15, 1994

Related U.S. Application Data

[63] Continuation-in-part of Ser. No. 10,595, Jan. 28, 1993, Pat. No. 5,342,178, which is a continuation-in-part of Ser. No. 963,850, Oct. 20, 1992, Pat. No. 5,286,173.

[30] Foreign Application Priority Data

Mar. 16, 1993 [JP] Japan ..... 5-056121

[51] Int. Cl.[6] ..... F04B 1/12

[52] U.S. Cl. ..... 417/222.2; 417/269; 74/60

[58] Field of Search ..... 417/222.1, 222.2, 269, 417/270; 137/625.21, 625.22, 625.23; 74/60

[56] References Cited

U.S. PATENT DOCUMENTS

| | | | |
|---|---|---|---|
| 1,367,914 | 2/1921 | Larsson . | |
| 2,160,978 | 6/1939 | Mock | 417/269 |
| 2,663,492 | 12/1953 | Eaton | 417/203 |
| 3,304,886 | 7/1967 | Roberts | 417/222.1 |
| 3,498,227 | 3/1970 | Kita | 417/269 |
| 3,696,710 | 10/1972 | Ortelli | 91/487 |
| 3,817,660 | 6/1974 | Knowles et al. | 417/269 |
| 3,851,669 | 12/1974 | Zellbeck et al. | 137/625.21 |
| 4,007,663 | 7/1977 | Nagatomo et al. | 417/269 |
| 4,174,191 | 11/1979 | Roberts | 417/269 |
| 4,226,572 | 10/1980 | Nakayama et al. | 417/269 |
| 4,347,778 | 9/1982 | Murray | 417/269 |
| 4,712,982 | 12/1987 | Inagaki et al. | 417/222 |
| 4,723,891 | 2/1988 | Takenaka et al. | 417/222 |
| 4,872,814 | 10/1989 | Skinner et al. | 417/222 |
| 4,880,361 | 11/1989 | Ikeda et al. | 417/269 |
| 5,174,728 | 12/1992 | Kimura et al. | 417/222.2 |
| 5,178,521 | 11/1993 | Ikeda et al. | 417/269 |
| 5,181,834 | 1/1993 | Ikeda et al. | 417/269 |
| 5,201,261 | 4/1993 | Kayukawa et al. | 92/71 |
| 5,207,078 | 5/1993 | Kimura et al. | 417/269 |
| 5,228,841 | 7/1993 | Kimura et al. | 417/222.2 |
| 5,232,349 | 8/1993 | Kimura et al. | 417/269 |
| 5,286,173 | 2/1994 | Takenaka et al. | 417/269 |
| 5,292,233 | 3/1994 | Takenaka et al. | 417/222.2 |
| 5,304,042 | 4/1994 | Kayukawa | 417/269 |
| 5,316,446 | 5/1994 | Kimura et al. | 417/269 |
| 5,336,056 | 8/1994 | Kimura et al. | 417/222.1 |
| 5,342,178 | 8/1994 | Kimura et al. | 417/269 |

FOREIGN PATENT DOCUMENTS 350135 3/1922 Germany .

*Primary Examiner*—Richard A. Bertsch
*Assistant Examiner*—Peter Korytnyk
*Attorney, Agent, or Firm*—Brooks Haidt Haffner & Delahunty

[57] ABSTRACT

A swash plate is mounted on a drive shaft disposed in a housing having a gas suction chamber in such a way that the swash plate is rotatable integrally with the drive shaft. A plurality of cylinder bores are formed around the drive shaft, extending along the drive shaft. Disposed in each cylinder bore is a piston, which reciprocates between top and bottom dead centers by undulating movement of the swash plate caused by rotation of the drive shaft. A compression chamber where gas is compressed by the reciprocal movement of the piston is defined in each cylinder bore. Provided between the drive shaft and the swash plate is a mechanism for altering an angle of the swash plate with respect to the axis of the drive shaft to change a reciprocal stroke of the piston to thereby control compression displacement. A rotary valve is provided at the drive shaft to be rotatable integrally with the drive shaft. The rotary valve has a passage for permitting uncompressed gas to move to each compression chamber from the suction chamber in synchronism with the reciprocal movement of the piston during rotation of the rotary valve before the piston reaches the bottom dead center. The compressor further comprises a mechanism for forcibly changing the timing at which the piston substantially reaches the top dead center in accordance with an inclined angle of the swash plate.

17 Claims, 14 Drawing Sheets

SWASH PLATE TYPE VARIABLE DISPLACEMENT COMPRESSOR

BACKGROUND OF THE INVENTION

This application is a continuation in part application of the U.S. patent application Ser. No. 08/010,595 filed on Jan. 28, 1993, now U.S. Pat. No. 5,342,178, which is a continuation-in-part of Ser. No. 08/963,850, filed Oct. 20, 1992, now U.S. Pat. No. 5,286,173, incorporated herein by reference.

FIELD OF THE INVENTION

The present invention relates to a swash plate type variable displacement compressor.

DESCRIPTION OF THE RELATED ART

A conventional swash plate type variable displacement compressor has the following structure. As shown in FIG. 17, a suction chamber 80 and a discharge chamber 81 are formed in a rear housing 82. Cylinder bores 84 are formed in a cylinder block 83. An inlet port 86 and a discharge port 87 are formed in a partition 85. A plate 88 has a flapper type inlet valve 89, and a plate 90 has a discharge valve 91.

When a piston 92 moves leftward in FIG. 17, the inlet valve 89 deforms to open the inlet port 86, allowing the gas in the suction chamber 80 to enter a compression chamber 93 in the cylinder bore 84 via the inlet port 86. After the suction is complete, the piston 92 moves rightward, causing the inlet valve 89 to close the inlet port 86. When the gas pressure in the compression chamber 93 becomes equal to or higher than a predetermined value thereafter, the discharge valve 91 elastically deforms to open the discharge port 87. Consequently, the gas in the compression chamber 93 is discharged via the discharge port 87 into the discharge chamber 81.

Typically, a lubricating oil mist is suspended in the gas, and attaches to the inlet valve 89. As a result, an oil film is formed between the inlet valve 89 and the partition 85, so that the inlet valve 89 sticks closely on the partition 85. The inlet valve 89 therefore will not easily be separated from the inlet port 86, and consequently delays the timing of the gas suction cycle. This delay reduces the amount of gas suction and lowers the pressure of the discharging gas, thus reducing the performance of the compressor. As the pressure in the compression chamber 93 drops, the inlet valve 89 opens the inlet port 86 against its own resilient force. In this respect, the pressure in the compression chamber 93 should be low enough to produce a counter force to the resilient force of the inlet valve 89. This effectively means that, the pressure in the compression chamber 93 cannot be set too high in a compressor which uses a flapper type inlet valve 89. In this respect, the performance of this type of compressor cannot be improved.

When the compressor runs at a high speed, the inlet valve 89 opens and closes the inlet port 86 very fast. When the inlet valve 89 closes the inlet port 86, therefore, the inlet valve 89 hits hard against the partition 85, producing large noise.

SUMMARY OF THE INVENTION

Accordingly, it is an object of the present invention to provide a swash plate type variable displacement compressor which has an improved efficiency and will suppress noise with a simple structure.

It is another object of this invention to provide a swash plate type variable displacement compressor which properly adjusts the suction starting timing of a gas suction mechanism when the displacement of the compressor changes due to a change in inclined angle of its swash plate, thus improving the compression efficiency and reducing noise.

To achieve the above objects, a swash plate type variable displacement compressor embodying this invention has a swash plate mounted on a drive shaft disposed in a housing having a gas suction chamber such that the swash plate is rotatable integrally with the drive shaft. A plurality of cylinder bores are formed around the drive shaft and extend longitudinally along the drive shaft. Disposed in each cylinder bore is a piston, which reciprocates between top and bottom dead center by the undulating movement of the swash plate caused by rotation of the drive shaft. A compression chamber where gas is compressed by the reciprocal movement of the piston is defined in each cylinder bore. Provided between the drive shaft and the swash plate is a mechanism for altering an angle of the swash plate with respect to the axis of the drive shaft to change a reciprocal stroke of the piston in order to thereby control compression displacement. A rotary valve is provided at the drive shaft to be rotatable integrally with the drive shaft. The rotary valve has a passage for permitting uncompressed gas to move to each compression chamber from the suction chamber in synchronism with the reciprocal movement of the piston during rotation of the rotary valve before the piston reaches the bottom dead center. The compressor further comprises a mechanism for forcibly changing the timing at which the piston approaches top dead center in accordance with an inclined angle of the swash plate.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENTS

A swash plate type variable displacement compressor according to a first embodiment of the present invention will now be described with reference to FIGS. 1 through 11.

Figure 1:
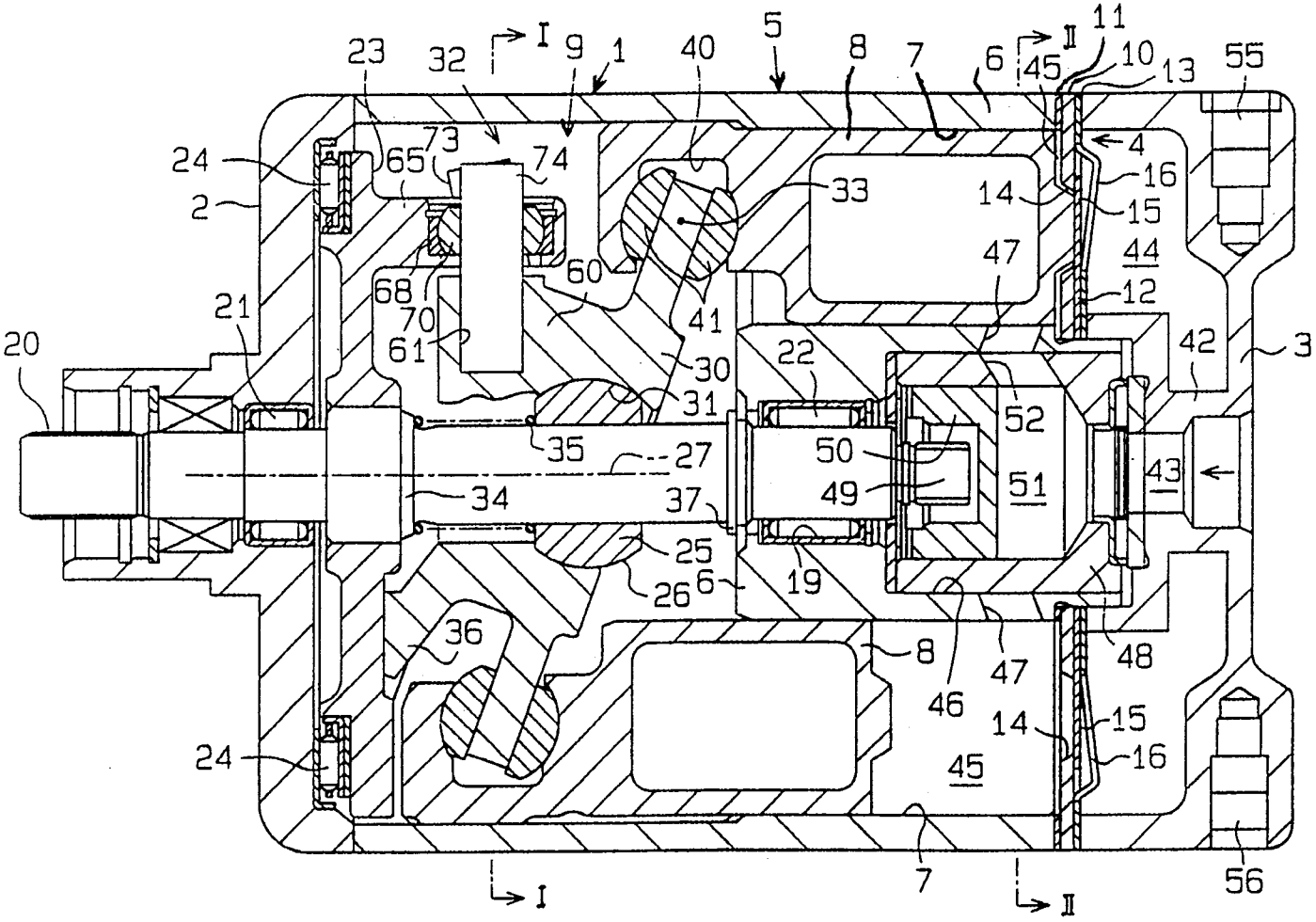
FIG. 1 is an elevational cross section illustrating a compressor according to a first embodiment of the present invention.

As shown in FIG. 1, a front end cover 2 is directly secured to a center housing 1. A rear housing 3 is secured to the center housing 1 by means of a partition 4. The center housing 1, the cover 2 and the rear housing 3 constitute a housing 5. A cylinder block 6 is integrally formed in the center housing 1. A plurality of cylinder bores 7 are formed in the cylinder block 6. A piston 8 is reciprocably disposed in each cylinder bore 7. A crank case or crank chamber 9 is defined in the center housing 1 between the cylinder block 6 and the cover 2.

The partition 4 includes a main plate 10, a gasket 11, a plate 12 and a retainer plate 13. A discharge port 14 is formed in the main plate 10. A reed valve 15 is formed on the plate 12 in association with the discharge port 14. A retainer 16 is formed on the retainer plate 13 to prevent excessive opening of the reed valve 15.

A drive shaft 20 is supported in the cover 2 and a central opening 19 of the cylinder block 6 respectively via bearings 21 and 22 so that the shaft 20 lies in the crank chamber 9. The shaft 20 is coupled to an engine (not shown). Secured to the shaft 20 is a drive plate 23 which is supported on the cover 2 via many rollers 24. A slider 25 having a convex surface 26 is slidably supported on the shaft 20, along the axis 27 of shaft 20. A swash plate 30, which has a concave surface 31 at the center, is supported by the slider 25 at that concave surface 31. The swash plate 30 pivots with respect to the concave surface 31 around the slider 25. The swash plate 30 is coupled via a hinge mechanism 32 to the drive plate 23.

The hinge mechanism 32 restricts the movement of the swash plate in such a way that the swash plate 30 rocks about a point 33 (hereinafter called "top position") as the slider 25 reciprocates. The top position 33 is set nearest to the cylinder block 6 in the swash plate 30, so that the top position 33 determines the top dead center of the piston 8. The hinge mechanism 32 allows for slight twisting of the swash plate 30 around the straight line passing the vicinity of the top position 33 and the center of the slider 25 as the center axial line. The structure of the hinge mechanism 32 will be discussed later.

As shown in FIG. 1, an expanding portion 34 is formed in the shaft 20, with a coil spring 35 disposed between this portion 34 and the slider 25. The spring 35 urges the swash plate 30 in the rear direction via the slider 25. A stopper 36 is formed integrally with the swash plate 30 so that the swash plate 30 is held at the maximum inclined position when this stopper 36 abuts on the drive plate 23. A stopper 37 is secured to the outer surface of the shaft 20, so that the swash plate 30 is held at the minimum inclined position (about 0.1 to 4 degrees with respect to the line perpendicular to the axial line 27) when the slider abuts on this stopper 37.

A recess 40 is formed in each piston 8 with a pair of shoes 41 disposed in that recess 40, as shown in FIG. 1. The peripheral portion of the swash plate 30 is held between the shoes 41.

The rotation of the shaft 20 is transmitted to the swash plate 30 via the drive plate 23 and the hinge mechanism 32. As the inclined swash plate 30 rotates, an undulating movement occurs, causing each piston 8 to reciprocate.

A cylindrical partition 42 is formed in the center portion of the rear housing 3 to define a suction chamber 43 and a discharge chamber 44.

The suction chamber 43 and discharge chamber 44 are connected to an external circuit via passages (not shown). The gas in the compression chamber 45 in the cylinder bore 7 is compressed by the piston 8, forcing the reed valve 15 open so that the compressed gas enters the discharge chamber 44. The gas flows through the discharge chamber 44 to the external circuit where the gas is expanded for refrigeration. The expanded gas then returns to the suction chamber 43.

A valve chamber 46, having a circular cross section and continuous to suction chamber 43, is formed at the center portion of the cylinder block 6. The valve chamber 46 and the compression chamber 45 are connected together by one of a plurality of communication passages 47 formed in the cylinder block 6. A rotary valve 48 having a circular cross section is retained in this valve chamber 46. A hexagonal projection 49 is formed at the rear end of the shaft 20. The rotary valve 48 is coupled to the projection 49 by a coupling 50. When the shaft 20 rotates, the rotary valve 48 also rotates so that the rotary valve 48 rotates together with the swash plate 30.

A suction passage 51, which always communicates with the suction chamber 43, is formed in the center portion of the rotary valve 48. The passage 51 has an outlet port 52 located at the outer surface of the rotary valve 48. The outlet port 52 is formed so that it can be associated with the communication passages 47. As the rotary valve 48 rotates, the outlet port 52 is connected to the communication passage 47 which corresponds to the phase of the suction stroke. When the rotary valve 48 rotates in the arrowhead direction in FIG. 3 and the outlet port 52 approaches the associated communication passage 47, the gas starts flowing into the compression chamber 45 via the suction chamber 43, the suction passage 51, the outlet port 52 and that communication passage 47. When the outlet port 52 leaves the communication passage 47, the gas suction stops. The outlet port 52 approaches the communication passage 47 at the timing when the piston 8 is substantially at top dead center.

When the piston 8 enters the discharge stroke, the associated communication passage 47 is closed by the outer surface of the rotary valve 48. Therefore, the compressed gas in the compression chamber 45 flows through the discharge port 14 of the partition 4 (see FIG. 1), forcing the valve 15 of the plate 12 open. The gas thereby enters the discharge chamber 44.

The pressure which acts on the face of each piston 8 changes in accordance with the reciprocal movement of the piston 8. The force corresponding to the difference between the pressure in the crank chamber 9, which acts on the back of the piston 8, and the pressure acting on the face of the piston 8 is transmitted to the swash plate 30 via the shoes 41. The force that the swash plate 30 receives from all the pistons 8 produces a moment which causes the swash plate 30 to rotate forward or backward around the slider 25. Accordingly, the angle of the swash plate 30 around the point 33 changes, and the stroke of the piston 8 is determined by that angle, thereby adjusting the displacement of the compressor.

As shown in FIG. 1, the rear housing 3 is provided with control valves 55 and 56 of a known type. (The control valves 55 and 56 incorporated herein are disclosed in U.S. Pat. No. 4,723,891). The valve 55 is disposed in a gas passage (not shown) between the discharge chamber 44 and crank chamber 9 to control the amount of gas flowing into the latter chamber 9 from the former chamber 44. The valve 56 is disposed in a passage (not shown) between the crank chamber 9 and the suction chamber 43 to control the amount of gas flowing out to the suction chamber 43 from the crank chamber 9. From the compression provided by the piston 8, a blow-by gas is continuously supplied to the crank chamber 9. The pressure in the crank chamber 9 is controlled by the actions of the valves 55 and 56; the pressure, in turn, changes the angle of the swash plate 30. The crank chamber 9 is connected to the suction chamber 43 via another passage which does not have the valve 55, and the gas in the crank chamber 9 always flows out to the suction chamber 43 along this passage.

The hinge mechanism 32 has the following structure.

Figure 2:
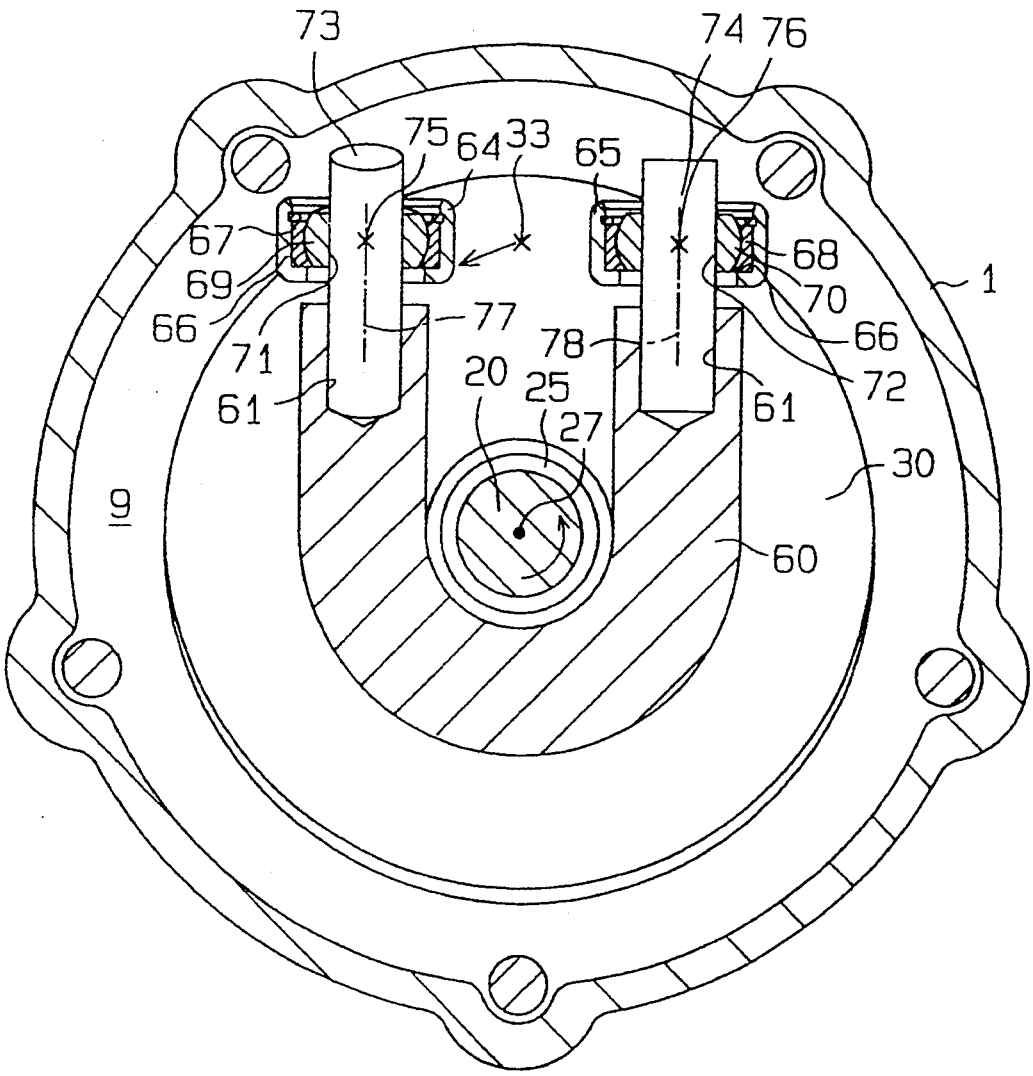
FIG. 2 is a cross section taken along the line I—I in FIG. 1.
Figure 3:
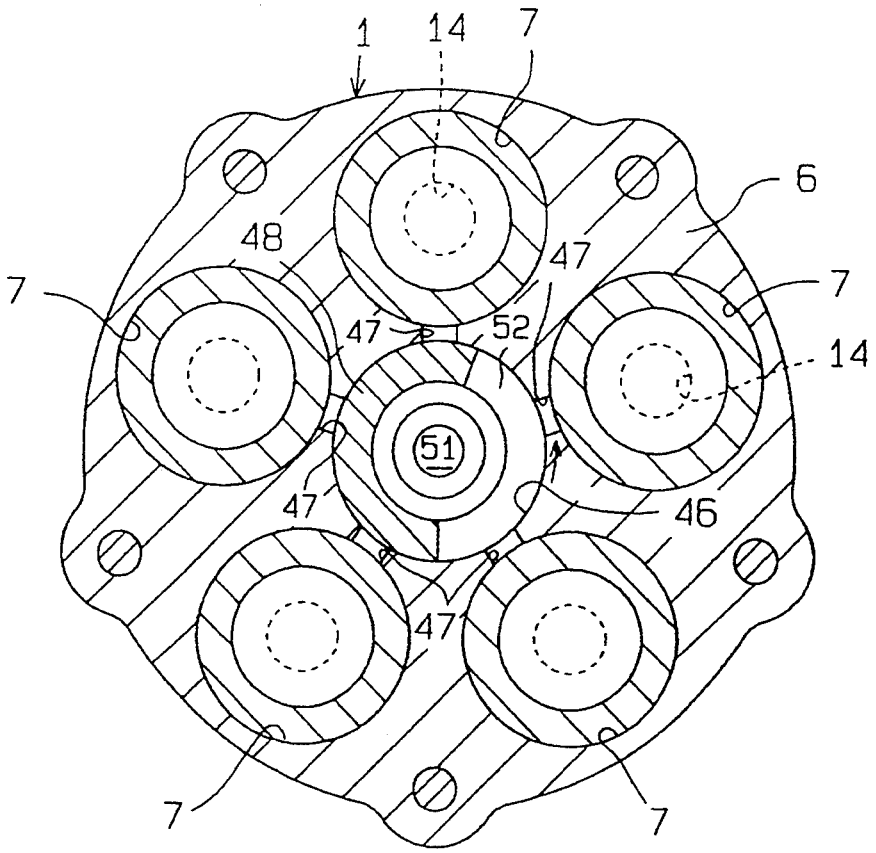
FIG. 3 is a cross section taken along the line II—II in FIG. 1.
Figure 4:
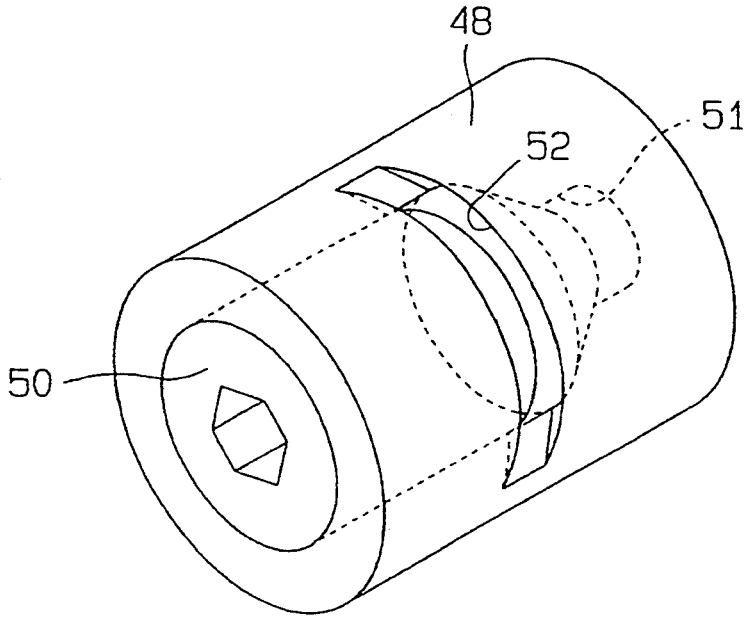
FIG. 4 is an enlarged perspective view of a rotary valve in the compressor shown in FIG. 1.

As shown in FIGS. 1 and 2, a bracket 60 is integrally formed on the swash plate 30, with a pair of holes 61 formed in that bracket 60. The bottom half portions of first and second guide pins 73 and 74 are respectively fitted in the holes 61 so that both pins 73 and 74 are secured to the bracket 60.

A pair of support arms 64 and 65 protrude from the peripheral portion of the drive plate 23 toward the swash plate 30. Holes 66 are respectively formed in both arms 64 and 65. Laces 67 and 68, each having a concave surface, are respectively fitted in the holes 66, so that the laces 67 and 68 are secured to the associated arms 64 and 65. Backing portions 69 and 70, each having an expanding curved surface, are supported on the concave surfaces of the laces 67 and 68, respectively, so that the backing portions 69 and 70 can rotate in all the directions about the centers of those concave surfaces. Guide holes 71 and 72 are formed in the center portions of the respective backing portions 69 and 70. The first and second guide pins 73 and 74 are inserted slidable in the holes 71 and 72, respectively. The rotational centers of the backing portions 69 and 70 lie symmetrical to each other with respect to the line that passes the top position 33 and the axial line 27.

Figure 5:
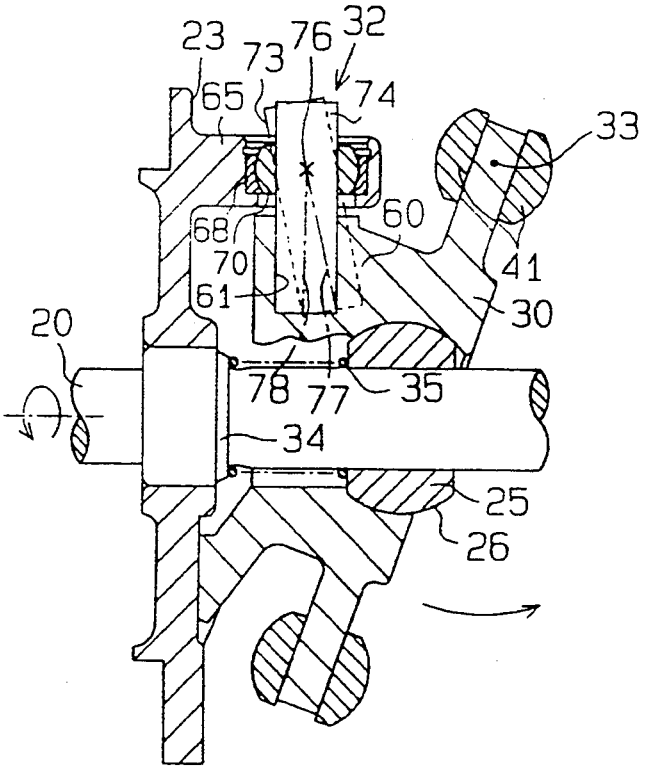
FIG. 5 is an enlarged cross section showing around a swash plate with the maximum inclined angle and a hinge mechanism.
Figure 6:
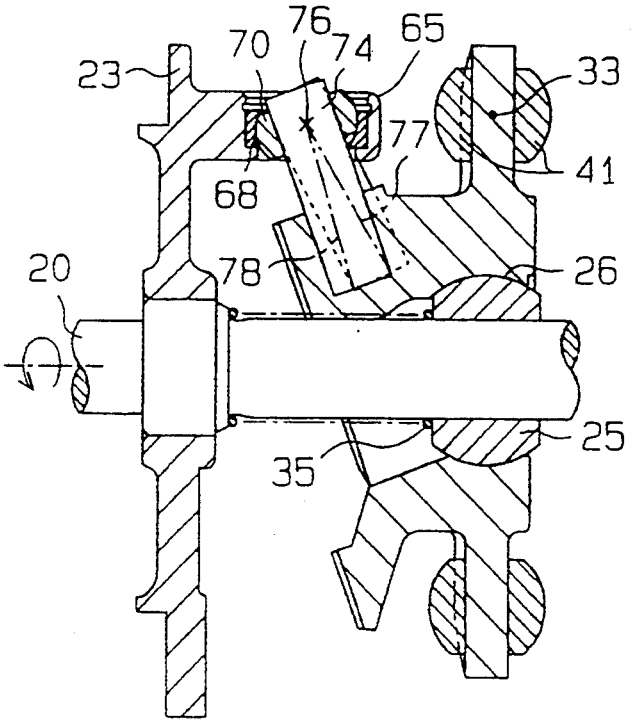
FIG. 6 is an enlarged cross section showing around the swash plate with the minimum inclined angle and the hinge mechanism.

As shown in FIGS. 1 and 2, the distances from the center of the slider 25 to the centers, 75 and 76, of both backing portions 69 and 70 (i.e., the rotational centers of both pins 73 and 74) are equal to each other. The pins 73 and 74 are parallel to each other as viewed from the direction in which the axial line 27 extends, as shown in FIG. 2. As shown in FIG. 5, the axes, 77 and 78, of both pins 73 and 74 cross each other, viewed from the direction perpendicular to the axial direction 27.

Figure 8:
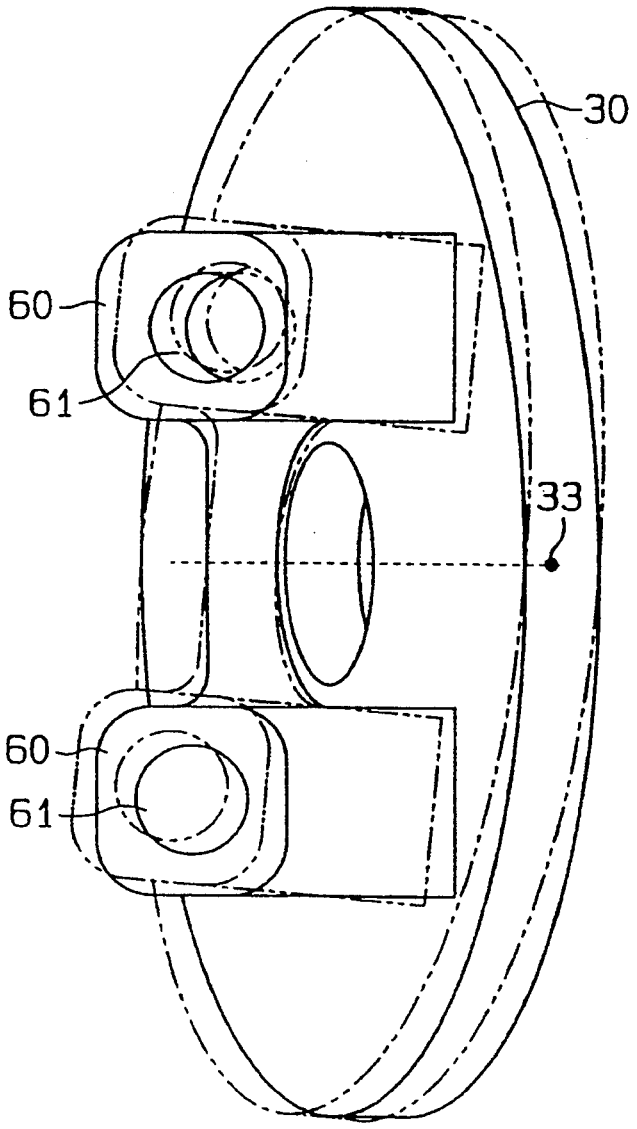
FIG. 8 is a plan view of the swash plate.

As the angle of the swash plate 30 changes, the slider 25 moves along the shaft 20. The swash plate 30 is thus guided by the convex surface 26 to rock around the top position 33. The pair of pins 73 and 74 rotate together with the swash plate 30 while sliding in the respective guide holes 71 and 72 of the backing portions 69 and 70. As a result, the top position 33 is kept at substantially the same position regardless of the angle of the swash plate 30 as shown in FIG. 8, so that the top dead center of the piston 8 in the reciprocal movement is always constant.

A description will now be given regarding the operation of the compressor having the above-described structure.

FIGS. 1, 2 and 5 show the swash plate 30 at the maximum inclined angle to provide the maximum-displacement operation. Under this situation, as the shaft 20 rotates, the swash plate 30 has an undulating movement at the maximum amplitude through the drive plate 23, the backing portions 69 and 70 and the pins 73 and 74. Accordingly, each piston 8 reciprocates with the maximum stroke. The reciprocal motion of the piston 8 causes the gas in the suction chamber 43 to enter the compression chamber 45, passing through the suction passage 51 of the rotary valve 48, the outlet port 52 and the associated communication passage 47. After being compressed in the compression chamber 45, the gas forces the reed valve 15 open, moving apart from the discharge port 14, and the gas thereby flows into the discharge chamber 44. This gas is then supplied to the external circuit.

The rotary valve 48 in this embodiment rotates in one direction as the shaft 20 rotates. Unlike the conventional structure which causes the flapper type inlet valve to stick on the plate, the gas can smoothly be introduced into the compression chamber 45 from the suction chamber 43 without causing the pressure in the compression chamber 45 to drop to abnormally low levels. This will improve the performance of the compressor. Because the rotary valve 48 merely rotates, guided by the inner wall of the chamber 46, in this compressor, compressor noise, like that generated by the flapper type inlet valves, is not produced, thus reducing the overall compressor noise.

In the initial stage of the compressor operation, the temperature inside a vehicle is high and the corresponding cooling load is high. The gas suction pressure is therefore high in this stage, so that the valve 56 is open. Accordingly, the gas in the crank chamber 9 returns to the suction chamber 43 from the crank chamber 9 via a passage (not shown), reducing the pressure inside the crank chamber 9. Therefore, the difference between the pressure in the crank chamber 9 which acts on the back of the piston 8 and the suction pressure in the compression chamber 45, which acts on the face of the piston 8, is small. This causes the swash plate 30 to move at the maximum inclined angle.

When the shaft 20 rotates at a high speed thereafter, or when the temperature in the vehicle drops and the cooling load decreases, the valve 56 closes the passage between the crank chamber 9 and the suction chamber 43 while the valve 55 opens the passage between the crank chamber 9 and the discharge chamber 44. Thus, the pressure in the crank chamber 9 rises, increasing the aforementioned pressure difference. Consequently, the inclined angle of the swash plate 30 becomes smaller and the stroke of the piston 8 becomes smaller, reducing the displacement of the compressor.

The principle of changing the opening/closing timing of the rotary valve 48 will be described below.

Figure 7:
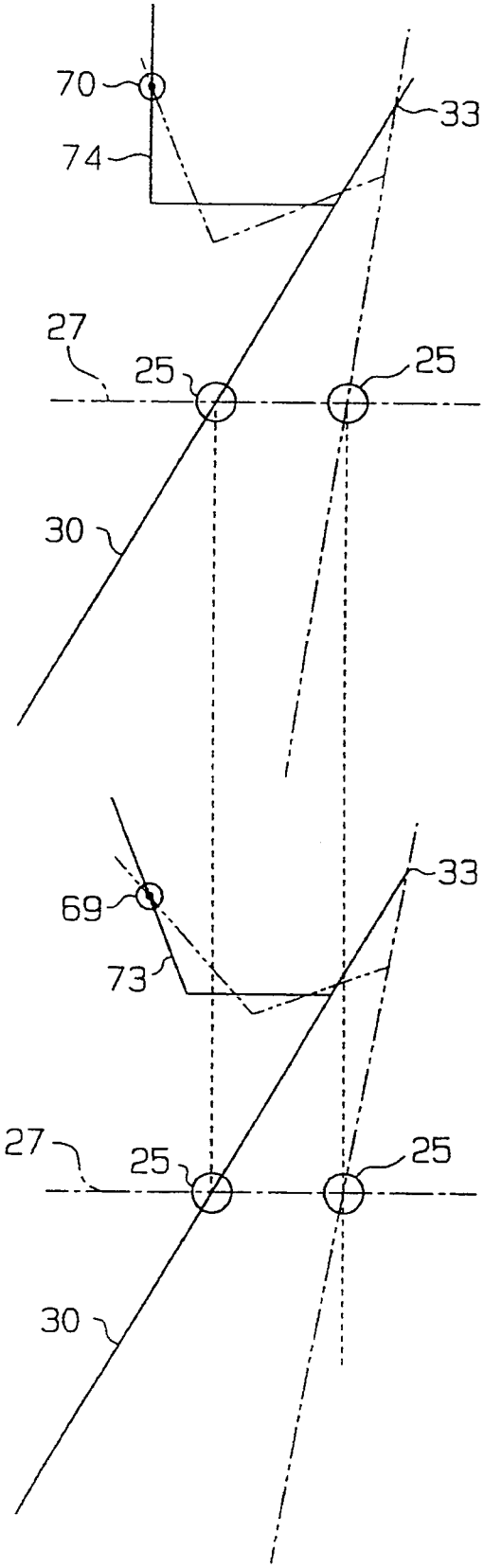
FIG. 7 is a diagram for explaining how the top position of the swash plate changes.

Referring to FIG. 7, the solid line shows the swash plate at the maximum inclination and the chain line shows the swash plate 30 at the minimum inclination. The bottom part of FIG. 7 shows the relation among the swash plate 30, the first guide pin 73 and the backing portion 69. The upper part of FIG. 7 shows the relation among the swash plate 30, the second guide pin 74 and the other backing portion 70.

In the upper part of FIG. 7, when the swash plate 30 rocks or pivots counterclockwise, the slider 25 slides along the axial line 27 and the second guide pin 74 slides within the backing portion 70, causing the portion 70 to rotate. In the lower part of FIG. 7, when the swash plate 30 rocks counterclockwise, the slider 25 likewise slides along the axial line 27 and the first guide pin 73 slides within the backing portion 69 while rotating the portion 69. Since the angle of the pin 73 differs from that of the pin 74 at this time, the swash plate 30 is twisted about the line that passes the center of the slider 25, near the top position 33. As a result, the top position 33 of the swash plate 30 moves away from the cylinder block 6. Another point on the swash plate 30, which has slightly advanced from the top position 33 in the rotational direction of the shaft 20, approaches closest to the cylinder block 6 (see FIG. 2).

Figure 9:
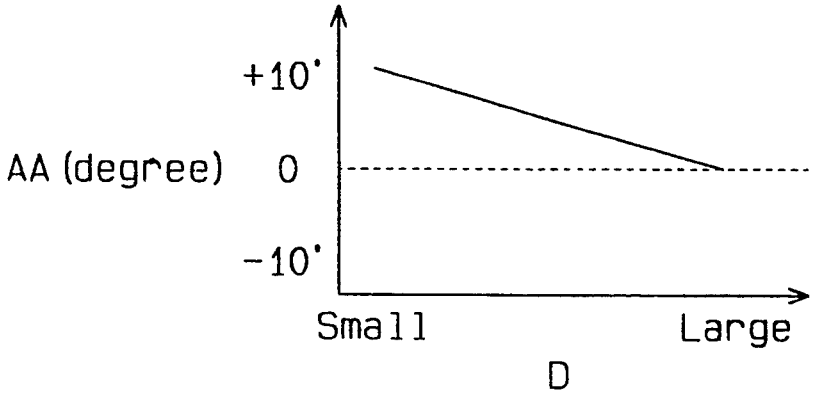
FIG. 9 is a graph showing the relation between the displacement of the compressor and the top position of the swash plate.
Figure 10:
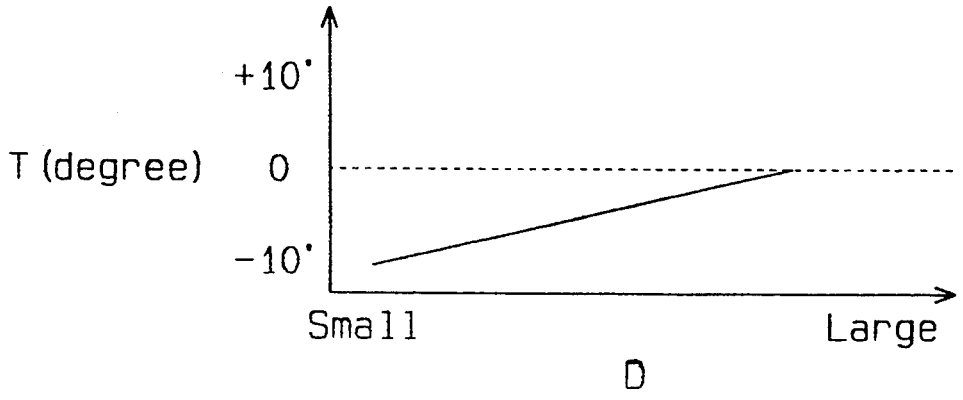
FIG. 10 is a graph showing the relation between the displacement of the compressor and the timing of the rotary valve.

The above relations become more prominent as the displacement D of the compressor decreases, and the maximum advance angle is about 10 degrees as shown in FIG. 9. When the compressor runs with a low displacement, therefore, the timing at which piston 8 reaches the top dead center is quickened by the advance angle AA. The rotary valve 48 however rotates together with the shaft 20, so that as the displacement of the compressor becomes smaller, the timing T of the movement of the rotary valve 48 to a position where the suction cycle begins is delayed for a period of time greater than that taken by the piston 8 to move to a position where the suction cycle begins. (See FIG. 10)

Figure 11:
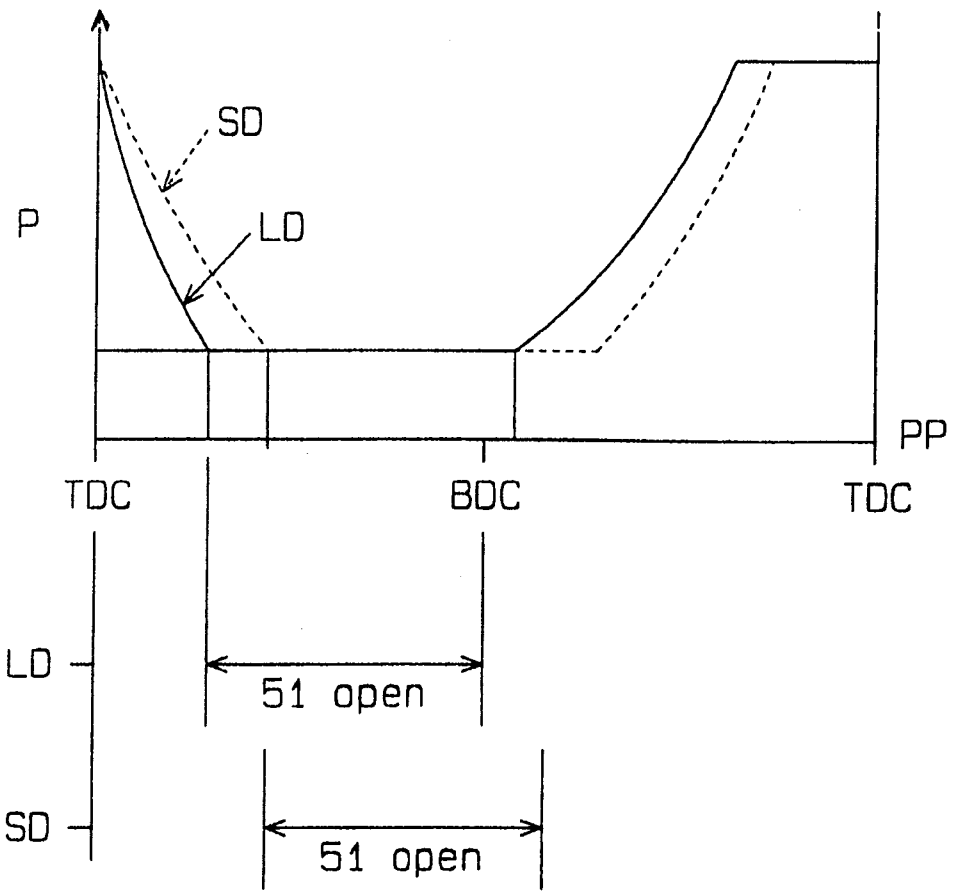
FIG. 11 is a graph showing the relation between the phase of a piston and the pressure in a compression chamber in a cylinder bore.

In the suction stroke where the piston 8 moves to the bottom dead center BDC from the top dead center TDC, the pressure P in the compression chamber 45 drops as shown in FIG. 11. PP in FIG. 11 represents positions of the piston 8. With the compressor running at a large displacement LD, the stroke of the piston 8 is large enough that the pressure in the compression chamber 45 drops to the suction pressure from the discharge pressure along the solid-line curve LD. The operational timings of the piston 8 and the rotary valve 48 are determined in such a way that when the pressure in the compression chamber 45 becomes almost equal to the suction pressure, the communication of the suction passage 51 (outlet port 52) of the rotary valve 48 with the associated communication passage 47 starts. Accordingly, the suction of gas into the compression chamber 45 is carried out properly. The compressor will therefore run at high efficiency.

When the compressor runs at a small displacement SD, the stroke of the piston 8 is sufficiently small to prevent the pressure in the compression chamber 45 from falling much. Therefore, the curve SD of the pressure change in the compression chamber 45 becomes gentler than the curve LD in the large displacement operation, as indicated by the broken line in FIG. 11. At this time, the suction cycle start and end timings by the rotary valve 48 lag as mentioned earlier. Even in the small displacement operation, therefore, when the pressure in the compression chamber 45 drops to the suction pressure from the discharge pressure, the suction passage 51 of the rotary valve 48 is connected to the compression chamber 45, as shown in FIG. 11. Accordingly, the blow-back of the gas toward the suction passage 51 from the compression chamber 45 is suppressed, thus suppressing uncomfortable noise and improving the compression efficiency.

When the inclined angle of the swash plate 30 changes to the maximum angle shown in FIG. 5 from the minimum angle, the lagging operation of the rotary valve 48 occurs which is quite opposite to the above-discussed advancing operation of the rotary valve 48.

According to the first embodiment, the operational timing of the rotary valve 48 can be altered by a simple structure where the inclined angle of the pin 73 differs from that of the pin 74. This embodiment eliminates the need for incorporating a complex and expensive timing changing mechanism in the portion where the shaft 20 is coupled to the rotary valve 48, and uses a simple timing changing structure so that the manufacturing and assembling of the compressor become easier.

Figure 12:
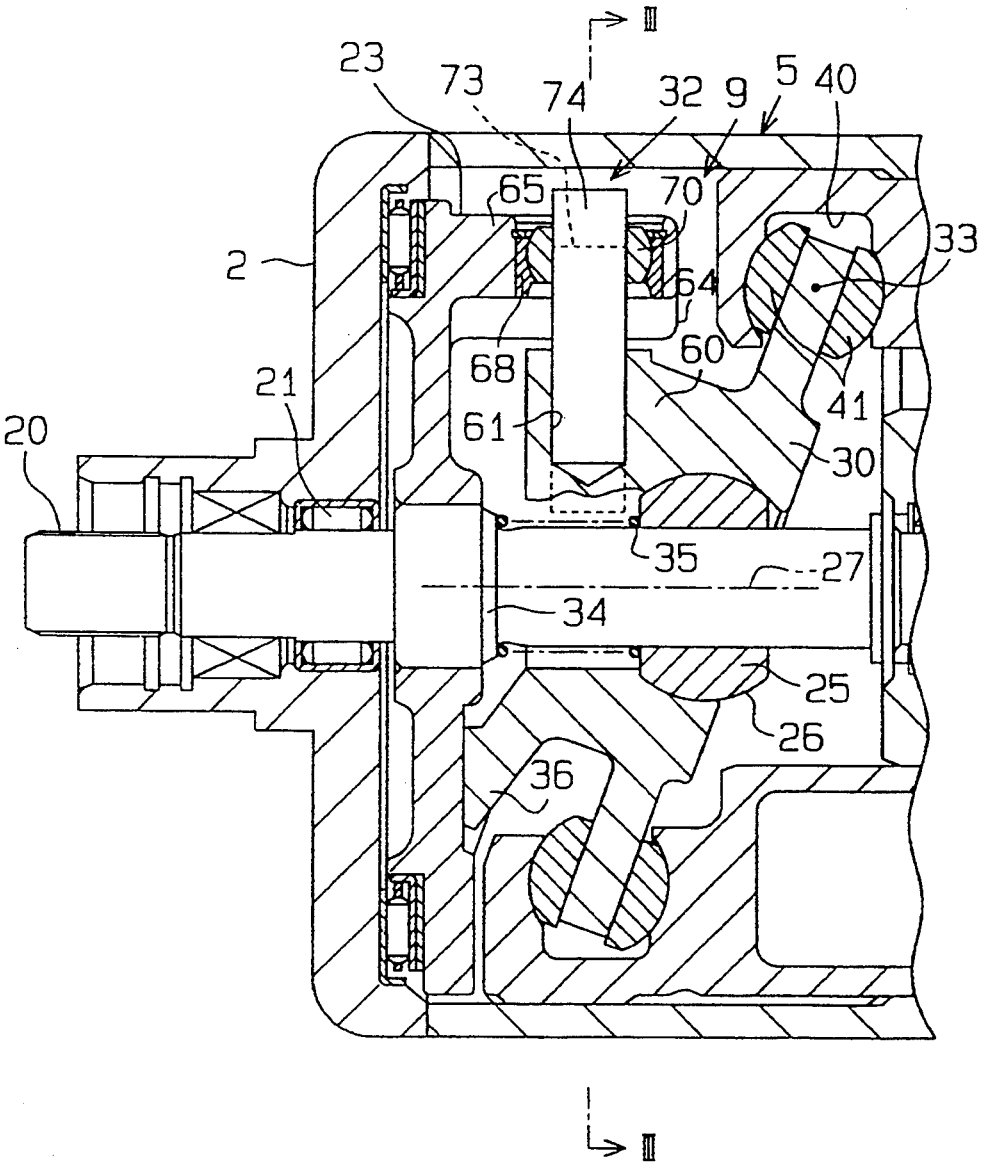
FIG. 12 is a cross-sectional view of a swash plate type variable displacement compressor according to a second embodiment of the present invention.
Figure 13:
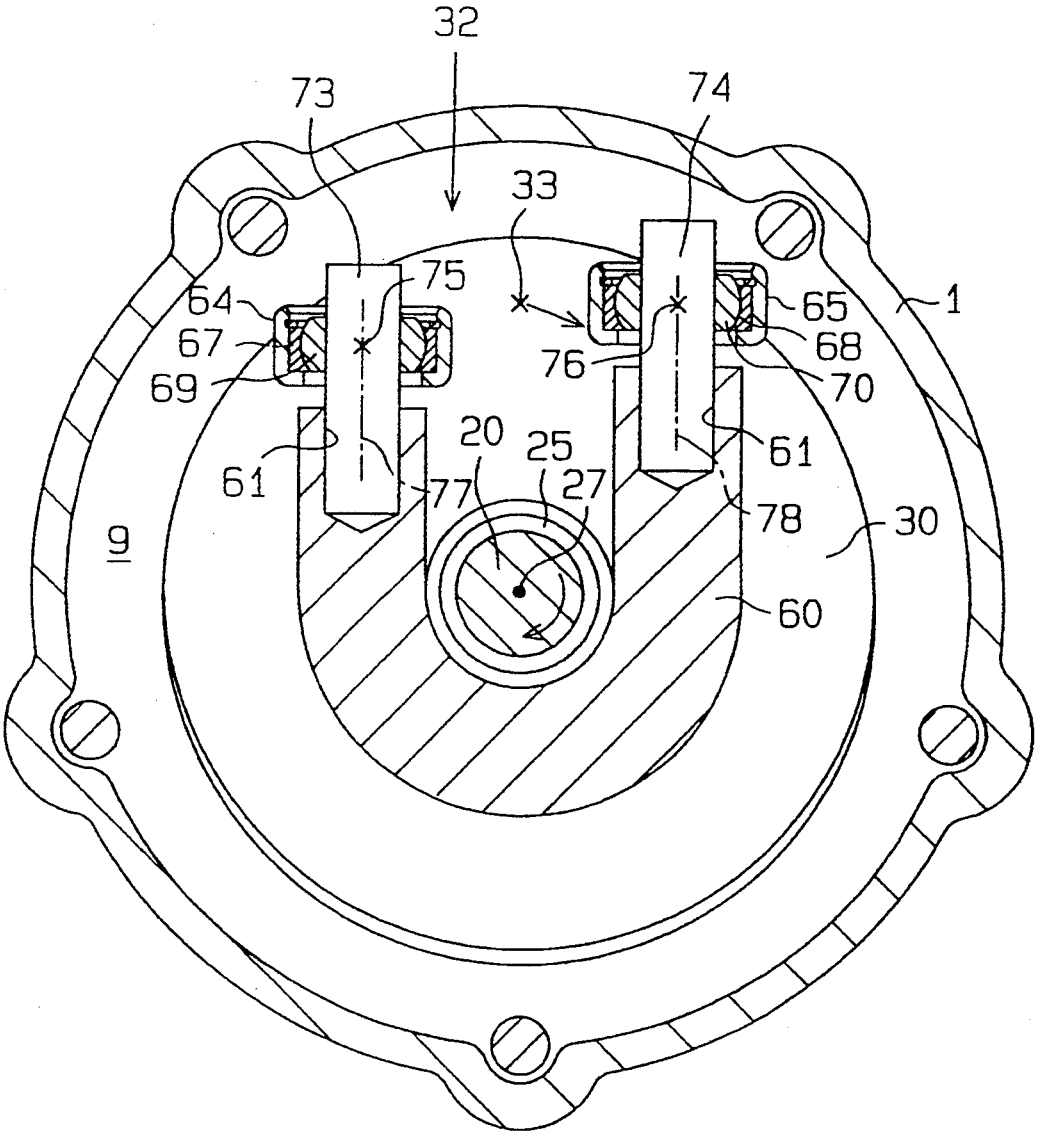
FIG. 13 is a cross section taken along the line III—III in FIG. 12.

A swash plate type variable displacement compressor according to a second embodiment of this invention will now be described with reference to FIGS. 12 to 14.

In the second embodiment, both pins 73 and 74 of the hinge mechanism 32 are provided in parallel to each other as viewed from the direction perpendicular to the axial line 27. The distance from the center of the slider 25 to the center 75 of the backing portion 69 is shorter than the distance from the center of the slider 25 to the center 76 of the other backing portion 70.

Figure 14:
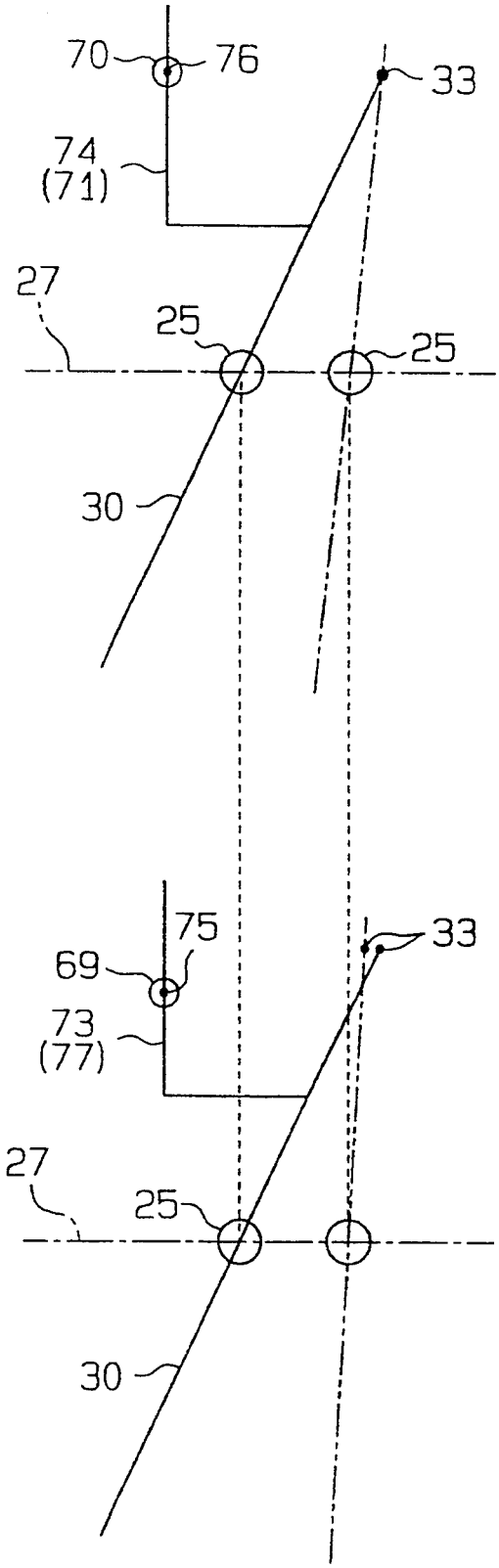
FIG. 14 is a diagram for explaining how the top position of a swash plate changes.

When the inclined angle of the swash plate 30 changes to the minimum angle from the maximum angle as indicated by the solid line in FIG. 14, due to the difference between both distances, the swash plate 30 is twisted about the line that passes the center of the slider 25 and near the top position 33, as per the first embodiment. As a result, the top position 33 of the swash plate 30 changes in the rotational angle of the shaft 20.

This embodiment employs a simple structure to change the operational timing of the rotary valve 48, so that the manufacturing and assembling of the compressor become easier. The other structure, operation and advantages are the same as those of the first embodiment.

The following will discuss two modifications of the hinge mechanism 32.

Figure 15:
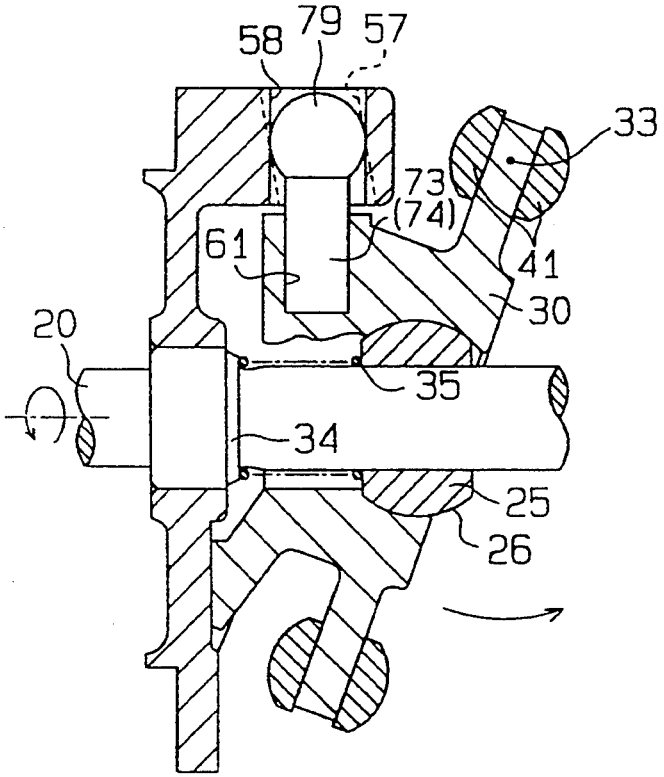
FIG. 15 is a cross section showing a modification of this invention.

In the first modification shown in FIG. 15, the first and second guide pins 73 and 74 are respectively inserted in a pair of holes 61 so that both pins 73 and 74 are secured to the swash plate 30. Formed at the free ends of both pins 73 and 74 are balls 79 which are fitted slidable in guide holes formed in the support arms 64 and 65, respectively.

Both holes 57 and 58 cross each other as viewed from the direction perpendicular to the axial line of the drive shaft 20. The other structure of this modification is the same as that of the first embodiment.

Figure 16:
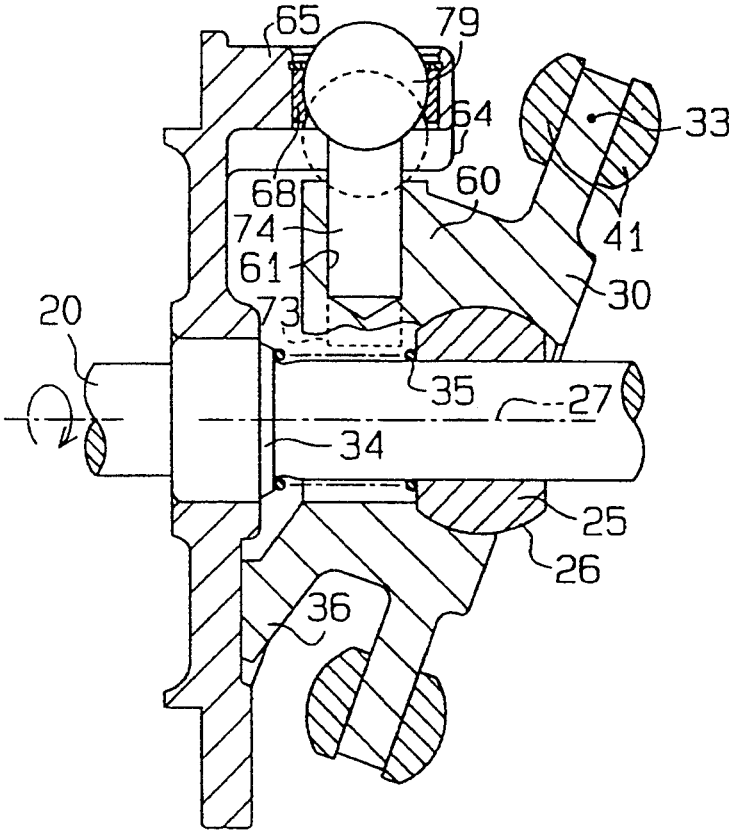
FIG. 16 is a cross section showing another modification of this invention.
Figure 17:
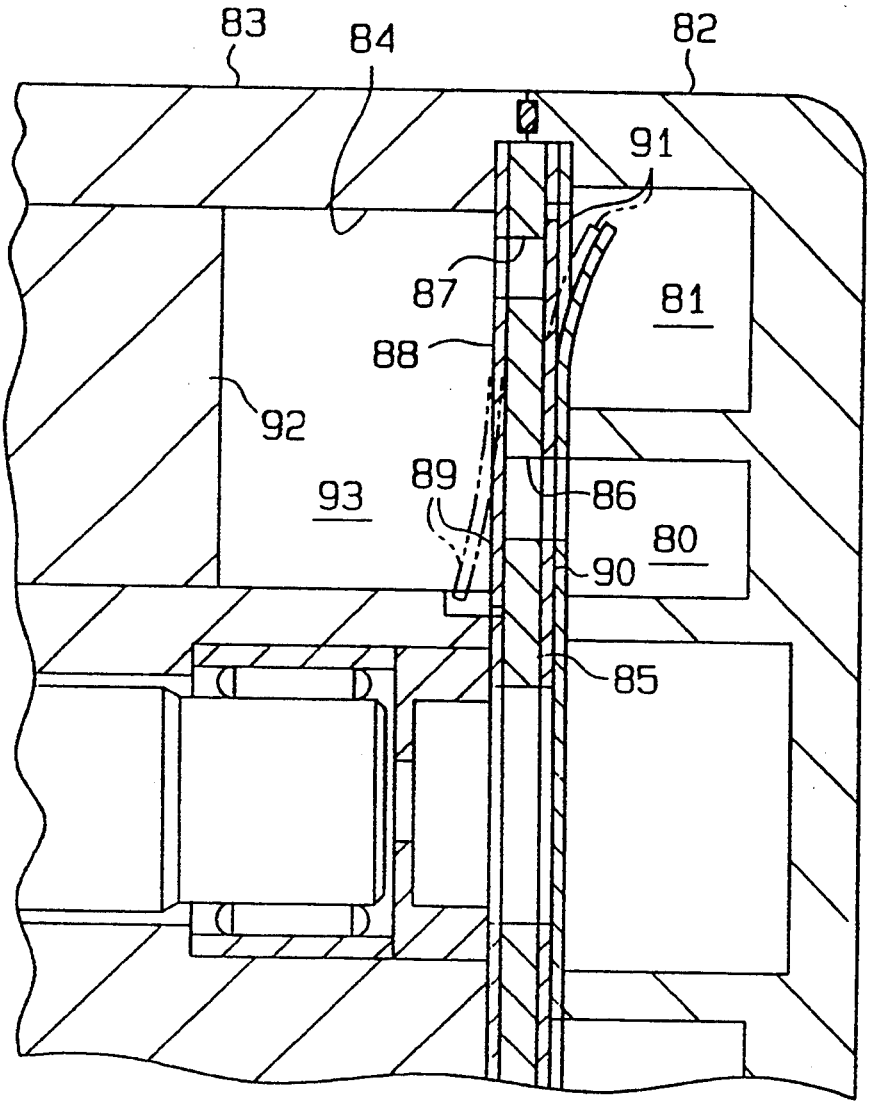
Fig. 17 (Prior Art)
FIG. 17 is a partial cross-sectional view of a conventional swash plate type compressor.

In the second modification shown in FIG. 16, the first and second guide pins 73 and 74 are inserted slidable in a pair of holes 61 respectively. Secured to the free ends of both pins 73 and 74 are balls 79 which are fitted in the concave portions of the laces 67 and 68 to be rotatable in all the direction. The other structure of this modification is the same as that of the second embodiment.

In both modifications discussed above, when the inclined angle of the swash plate 30 changes to the minimum angle from the maximum angle, the swash plate 30 is twisted about a line that passes the center of the slider 25 and near the top position 33, as per the first and second embodiments. The top position 33 of the swash plate 30 therefore changes in the rotational angle of the shaft 20. Both modifications will simplify the structure to change the operational timing of the rotary valve 48, so that the manufacturing and assembling of the compressor become easier.

What is claimed is:

1. A compressor having a swash plate mounted on a drive shaft, disposed in a housing having a gas suction chamber, in such a way as to be rotatably integral with said drive shaft, a plurality of cylinder bores formed around said drive shaft and extending along said drive shaft, pistons disposed respectively in said cylinder bores, said pistons being reciprocatable between top and bottom dead centers by undulating movement of said swash plate caused by rotation of said drive shaft, reciprocal movement of each piston in each cylinder bore defining a compression chamber where gas is compressed, and means for altering an angle of said swash plate with respect to an axis of said drive shaft to change a reciprocal stroke of each piston to thereby control compression displacement, said compressor comprising:

rotary valve means provided at said drive shaft to be rotatable integrally with said drive shaft and having a passage for permitting uncompressed gas to move to each compression chamber from said suction chamber in synchronism with said reciprocal movement of each piston during rotation of said rotary valve before said each piston reaches said bottom dead center; and means for forcibly changing a timing at which said each piston reaches substantially said top dead center in accordance with an inclined angle of said swash plate.

2. The compressor according to claim 1, wherein when said swash plate rocks in such a way that said inclined angle of said swash plate decreases, said timing at which each piston reaches said top dead center is changed.

3. The compressor according to claim 1, wherein when said inclined angle of said swash plate changes to a minimum angle from a maximum angle, said swash plate moves forward by ten degrees in a rotational direction of said drive shaft, thereby changing said timing at which each piston reaches said top dead center.

4. The compressor according to claim 1, wherein each piston has a pair of shoes between which a peripheral portion of said swash plate is held.

5. The compressor according to claim 4, wherein said swash plate rocks substantially about one section of that part of said swash plate which is held between said shoes.

6. The compressor according to claim 4, wherein said drive shaft is provided with a slider reciprocatable along said drive shaft, and said swash plate is supported on said slider.

7. The compressor according to claim 4, wherein said drive shaft is provided with a plate rotatably integral with said drive shaft, and wherein a hinge mechanism is provided between said plate and said swash plate to change the timing at which each piston reaches said top dead center.

8. The compressor according to claim 7, wherein a pair of hinge mechanisms are provided and wherein the coupling between one of said hinge mechanisms and said swash plate differs from coupling between the other hinge mechanism and said swash plate.

9. The compressor according to claim 7, wherein said hinge mechanism includes:

a pair of support arms secured to said plate;

a pair of curved-surface receiving portions respectively supported on said support arms equidistant from said drive shaft; and first and second guide pins secured to said swash plate and fitted reciprocally in guide holes of said receiving portions respectively, said guide pins being parallel to each other as viewed from an axial direction of said drive shaft, said guide pins crossing each other at a predetermined angle as viewed from a direction perpendicular to said axis of said drive shaft.

10. The compressor according to claim 9, wherein said swash plate rotates about a line passing said axis of said drive shaft to change said timing at which each piston reaches said top dead center.

11. The compressor according to claim 7, wherein said hinge mechanism includes:

a pair of support arms secured to said plate;

a pair of curved-surface receiving portions respectively supported on said support arms; and a pair of guide pins secured to a back of said swash plate and fitted reciprocally in guide holes of said receiving portions respectively, distances from a same position on said drive shaft to said pair of receiving portions being different from each other.

12. The compressor according to claim 11, wherein said swash plate rotates about a line passing said axis of said drive shaft to change said timing at which each piston reaches said top dead center.

13. The compressor according to claim 1, wherein said rotary valve means is secured to an end portion of said drive shaft.

14. The compressor according to claim 1, wherein said housing has a cylinder block in which said cylinder bores are formed.

15. The compressor according to claim 14, wherein said cylinder block has a recessed valve chamber and communication passages for connecting said compression chambers to said cylinder bores, and said rotary valve means is retained in said valve chamber and is secured to an end portion of said drive shaft.

16. A swash plate type variable displacement compressor having a swash plate mounted on a drive shaft, disposed in a housing having a gas suction chamber, in such a way as to be rotatable integrally with said drive shaft, a plurality of cylinder bores formed around said drive shaft and extending along said drive shaft, pistons disposed respectively in said cylinder bores, said pistons being reciprocative between top and bottom dead centers by undulating movement of said swash plate caused by rotation of said drive shaft, reciprocal movement of each piston in each cylinder bore defining a compression chamber where gas is compressed, and means for altering an angle of said swash plate with respect to an axis of said drive shaft to change a reciprocal stroke of each piston to thereby control compression displacement, said compressor comprising:

rotary valve means provided at said drive shaft to be rotatable integrally with said drive shaft and having a passage for permitting uncompressed gas to move to each compression chamber from said suction chamber in synchronism with said reciprocal movement of each piston during rotation of said rotary valve before said each piston reaches said bottom dead center; and means, provided between said drive shaft and said swash plate, for advancing a top position of said swash plate in a rotational direction of said drive shaft as said swash plate moves to an upright position.

17. A swash plate type variable displacement compressor comprising:

a housing having a crank chamber, a suction chamber and a discharge chamber therein;

a drive shaft rotatably supported inside said housing;

a cylinder block provided in said housing and having a plurality of cylinder bores extending around said drive shaft along an axis thereof;

pistons disposed respectively in said cylinder bores to be reciprocative between top and bottom dead centers along said axis of said drive shaft;

a plate secured to said drive shaft to be rotatable integrally with said shaft;

a swash plate supported on said drive shaft, reciprocative along said axis of said drive shaft and rockable with respect to said axis thereof;

a hinge mechanism by which said swash plate is coupled to said plate, whereby undulating movement of said swash plate caused by rotation of said drive shaft causes said pistons to reciprocate, a difference between pressure in said suction chamber and pressure in said crank chamber is adjusted to change an angle of said swash plate to alter a reciprocal stroke of each piston, thereby changing a compression displacement, and a top position of said swash plate for determining said top dead center of each piston is set substantially constant; and a gas suction mechanism including, a valve chamber formed in a center portion of said cylinder block and communicatable with said suction chamber, communication passages for respectively connecting said valve chamber with said cylinder bores, a rotary valve rotatably retained in said valve chamber, coupling means for coupling said rotary valve to said drive shaft, and a gas suction passage, formed in said rotary valve, for allowing each of said communication passages to communicate with said suction chamber in a gas suction stroke of each piston; and top position changing means, provided between said drive shaft and said swash plate, for advancing said top position of said swash plate in a rotational direction of said drive shaft as said swash plate moves to an upright position.

* * * * *

UNITED STATES PATENT AND TRADEMARK OFFICE

CERTIFICATE OF CORRECTION

PATENT NO. : 5,417,552
DATED : May 23, 1995
INVENTOR(S) : H. Kayukawa et al

It is certified that error appears in the above-indentified patent and that said Letters Patent is hereby corrected as shown below:

Column 1, line 9, "08/963,850," should read --07/963,850--;
line 10, before "incorporated" insert --which are--.

Column 7, line 32, after "degrees" insert comma --,--;
line 42, "(See FIG. 10)" should read --(See, FIG. 10).--.

Signed and Sealed this

Nineteenth Day of December, 1995

*Attest:*

Bruce Lehman

BRUCE LEHMAN

*Attesting Officer*

*Commissioner of Patents and Trademarks*